US007089078B2

(12) United States Patent
Hahn et al.

(10) Patent No.: US 7,089,078 B2
(45) Date of Patent: Aug. 8, 2006

(54) METHOD AND DEVICE FOR ADJUSTING THE DEGREE OF ENGAGEMENT OF A TOOL WITH A WEB OF A MATERAIL RUNNING PAST IT

(75) Inventors: Ingo Hahn, Lohr am Main (DE); Christoph Mueller, Lohr am Main (DE)

(73) Assignee: Rexroth Indramat GmbH, Lohr am Main (DE)

( * ) Notice: Subject to any disclaimer, the term of this patent is extended or adjusted under 35 U.S.C. 154(b) by 0 days.

(21) Appl. No.: 10/399,969

(22) PCT Filed: Oct. 26, 2001

(86) PCT No.: PCT/DE01/04026

§ 371 (c)(1),
(2), (4) Date: Sep. 11, 2003

(87) PCT Pub. No.: WO02/34484

PCT Pub. Date: May 2, 2002

(65) Prior Publication Data

US 2004/0059457 A1 Mar. 25, 2004

(30) Foreign Application Priority Data

Oct. 26, 2000 (DE) ..... 100 53 247

(51) Int. Cl.
*B23Q 15/00* (2006.01)
*G06F 19/00* (2006.01)

(52) U.S. Cl. ..... 700/122; 700/127; 226/17; 83/72

(58) Field of Classification Search ..... 700/122, 700/124, 127, 128, 151; 226/17, 34; 83/72, 83/76, 324, 354
See application file for complete search history.

(56) References Cited

U.S. PATENT DOCUMENTS 4,170,155 A 10/1979 Saito et al. ..... 83/76

(Continued)

FOREIGN PATENT DOCUMENTS

| | | |
|---|---|---|
| DE | 36 08 111 C1 | 10/1987 |
| EP | 0 001 565 A | 5/1979 |
| EP | 0 035 462 A | 9/1981 |

OTHER PUBLICATIONS

Sisa E M et al: "New Risc Processor Control for Direct Drive Sheeters" Pulp and Paper Industry Technical Conference, 1994, Conference Record of 1994 Annual Nashville, TN, USA Jun. 20-24, 1994 New York, NY, USA IEEE, Jun. 20, 1994, pp. 45-51.

(Continued)

*Primary Examiner*—Jayprakash N. Gandhi
(74) *Attorney, Agent, or Firm*—Michael J. Striker

(57) ABSTRACT

The invention relates to a method for adjusting the degree of engagement of a tool (6, 7) disposed on the outer radius of at least one associated rotating roll (4, 5) with a web of material (1) running past it. The aim of the invention is to improve the method so that the degree of engagement of the tool can be adjusted without loss of time and without producing any scraps. To this end, for adjusting the degree of engagement of the tool (6, 7) with the web of material (1), first several different degrees of engagement are electronically defined by means of different peripheral speeds of the tool (6, 7) so as to be retrievable. Once an adjuster (13) is activated, the change to another defined degree of engagement takes place during operation precisely when the tool (6, 7) engages with the web so that the new degree of engagement is carried out when the tool (6, 7) engages with the web of material (1) for the next time.

14 Claims, 2 Drawing Sheets

U.S. PATENT DOCUMENTS

| | | | | |
|---|---|---|---|---|
| 4,201,102 | A * | 5/1980 | Rudszinat | 83/298 |
| 4,255,998 | A * | 3/1981 | Rudszinat | 83/298 |
| 4,283,975 | A | 8/1981 | Knoll | 83/76 |
| 4,440,051 | A * | 4/1984 | Aykut | 83/72 |
| 4,881,436 | A | 11/1989 | Rommel | |
| 5,600,221 | A | 2/1997 | Tomatsuri et al. | 318/632 |
| 5,662,018 | A | 9/1997 | Klein | |
| 5,713,256 | A * | 2/1998 | Keeny | 83/26 |
| 5,899,128 | A * | 5/1999 | Smithe et al. | 83/76 |
| 6,173,633 | B1 * | 1/2001 | McLaughlin | 83/37 |
| 6,604,444 | B1 * | 8/2003 | Belanger et al. | 83/155 |

OTHER PUBLICATIONS

Patent Abstracts of Japan vol. 1996, No. 03, Mar. 29, 1996 & JP 07 311609 A, Nov. 28, 1995.

* cited by examiner

METHOD AND DEVICE FOR ADJUSTING THE DEGREE OF ENGAGEMENT OF A TOOL WITH A WEB OF A MATERAIL RUNNING PAST IT

BACKGROUND OF THE INVENTION

The invention relates to a method and a device for changing the spacing at which at least one tool, which is disposed on the radial outside of an associated rotating roller, engages with a web of material running past.

Tool-equipped rollers are used to process material webs running past them, for example as cross cutters for paper. A paper cross cutter is used to cut a paper web—which is wound on a roll—by means of a tool in the form of a knife, into individual segments that usually correspond to standardized formats. The current invention can be used in all machines in which a chronologically periodic movement of a tool occurs, for example crosscut saws or bag forming, filling, and sealing machines, and the like.

U.S. Pat. No. 5,662,018 has disclosed a paper cross cutter that is comprised of two opposing rollers, which are each equipped with a number of knives disposed on the radial outside, in order to cut a material web—which is being conveyed between the two rollers—into predetermined segments. During the engagement of the tools with the material web, the circumferential speed of the tool is synchronized with the speed of the material web in order to permit the cut to be executed along a correct line. This device also makes it possible to cut the material web in different formats. A changeover of the consequently required engagement spacing of the knife-like tool is achieved by virtue of the fact that different tools are associated with different engagement spacings, where of the tools that are kept on hand, the tools that produce the desired engagement spacing are the ones that are brought into engagement. The tool engagement is controlled mechanically by means of hydraulic adjusting mechanisms. A disadvantage of this changing of the engagement spacing lies in the rather complex design of the device, which is expensive to assemble and is subject to wear due to the large number of individual mechanical parts.

By contrast, DE 36 08 111 C1 has disclosed changing the engagement spacing of a tool through the use of electronic means. Two opposing rollers, each of which is provided with a respective tool in the form of a knife, are driven directly by means of respectively associated electric motors. The upper roller is driven with the lower roller by means of a gear transmission in order to synchronize the rotating rollers.

Special d.c. motors are used as the electric motors, which are driven discontinuously by a shared electronic control unit, as a function of various input data, i.e. in a manner similar to disk-cam control. The input data for the control unit include the circumferential speed of the tool detected by an incremental transducer as well as data regarding the speed of the material web traveling through the rollers. It is also possible to preset a desired engagement spacing of the tool, i.e. a desired format length. Depending on these data, the two special d.c. motors are controlled so that starting from a standstill, they can be brought extremely quickly to their full speed, which corresponds to the respective speed of the material web. This speed is kept constant for the entire duration of the cutting procedure. Depending on the desired format length, the motor can be adjusted down to a lower speed and then for the cutting procedure, can be accelerated back to the full speed. For smaller formats, after passing the cutting speed, the motor can be accelerated to higher speeds in order to rotate the roller at an increased speed and to execute the cut before the material web has traveled the distance of the so-called synchronous format, which corresponds to the revolution circumference of the knife.

In the above-described known method for determining the spacing at which knives, which are disposed on the radial outside of rotating rollers, engage with a passing material web, the problem arises that although it is possible to change the engagement spacing during operation, i.e. to change the format length, waste is produced during the time it takes to change the format length. In order to avoid generating such waste while changing the engagement spacing, it was previously customary to first turn off the machine, set the machine to the new engagement spacing, and then turn the machine back on. On the other hand, however, this procedure requires a lot of time, which is disadvantageous in mass production, and generates waste during the run-up and braking.

SUMMARY OF THE INVENTION

The object of the current invention, therefore, is to further improve the method of this generic type as well as the device associated with it so that it is possible to change the engagement spacing of the tool without the generation of waste or loss of time.

The invention includes the process engineering-based teaching that in order to change the spacing at which the tool engages in the passing material web, first a number of different engagement spacings in conjunction with corresponding different circumferential speeds of the tool are predefined, i.e. provided, in a retrievable form, wherein after the activation of a changeover switch, the change to another predefined engagement spacing during operation is executed precisely at the moment the tool engages so that the next time the tool engages with the material web, the new engagement spacing is executed.

The advantage of the method according to the invention lies particularly in that it does not generate any waste associated either with the preceding engagement spacing or with the new engagement spacing. Consequently, the method according to the invention can execute a waste-free changeover of the engagement spacing at full web speed without the machine being switched off. This is achieved through the immediate provision of control data by electronic means, wherein the changeover itself is favorably controlled in a waste-free manner as a function of the engagement situation of the tool with the material web. This is achieved in that the time during the engagement of the tool is used to electronically execute a change to a new engagement spacing. The synchronous running continues to be maintained during the engagement so that the new circumferential speed of the tool becomes effective immediately thereafter.

Preferably the circumferential tool speed to be executed for this is determined in such a way that a uniform motion component is executed as a fundamental motion in order to determine the engagement spacing and is overlaid with a compensation component—which produces an acceleration or braking—in order to achieve an adaptation to the circumferential speed synchronous to the material web during the engagement of the tool. In order to produce a shorter engagement spacing of the tool, a faster uniform motion component of the roller relative to the speed of the material web can be executed, whereas in order to produce a longer engagement spacing of the tool, a relatively slower uniform motion component of the roller is executed.

The method described above is preferably executed by means of a device that includes an electronic control unit, which provides, in a retrievable form, the different circumferential speeds that represent desired engagement spacings. After the activation of a changeover switch, the control unit executes the change to a different predefined engagement spacing precisely at the moment the tool engages.

A sensor is provided to measure the material web speed data required for this and this sensor determines the corresponding desired values in order to control the rollers in accordance with the principle of a real guide axle. In addition, it is also possible to use speed data that are obtained in accordance with the principle of a virtual guide axle. Advantageously, these desired values are provided to a drive regulating unit associated with each roller, which allows the associated roller to be directly controlled in a position-controlled manner.

In addition, a separate computing unit—preferably a PC—can be provided, which is directly connected to the control unit and which, based on various desired engagement spacings of the tool, calculates various corresponding disk-cam-like circumferential speeds of the tool. In this respect, the software used for this purpose functions as a disk-cam-generating tool. The constant rotary motion of the virtual guide axle is converted into a chronologically desirable rotary motion of the roller. In this connection, for every rotation of the roller, there is a region of constant circumferential speed, which coincides with the web speed in order to achieve a synchronous engagement with the material web. The speed in the remaining region is used to determine the distance at which the tool engages with the material web.

According to another step that improves the device according to the invention, the data determined by the computer, together with the virtual guide axle transmission data determined by means of the control unit, are stored directly in the drive regulating unit associated with each roller. Preferably, the control unit has a binary input that functions as a changeover switch. The changeover switch executes a change among a number of disk-cam-like sets of data stored in the drive regulating unit at the same time as the associated guide axle transmission data. The simultaneous changeover assures that the synchronization of the web speed with the circumferential speed of the tool is maintained at all times.

Other steps that improve the invention will be explained in detail below, along with the description of a preferred exemplary embodiment of the invention in conjunction with the drawings.

DESCRIPTION OF THE PREFERRED EMBODIMENTS

Figure 1:
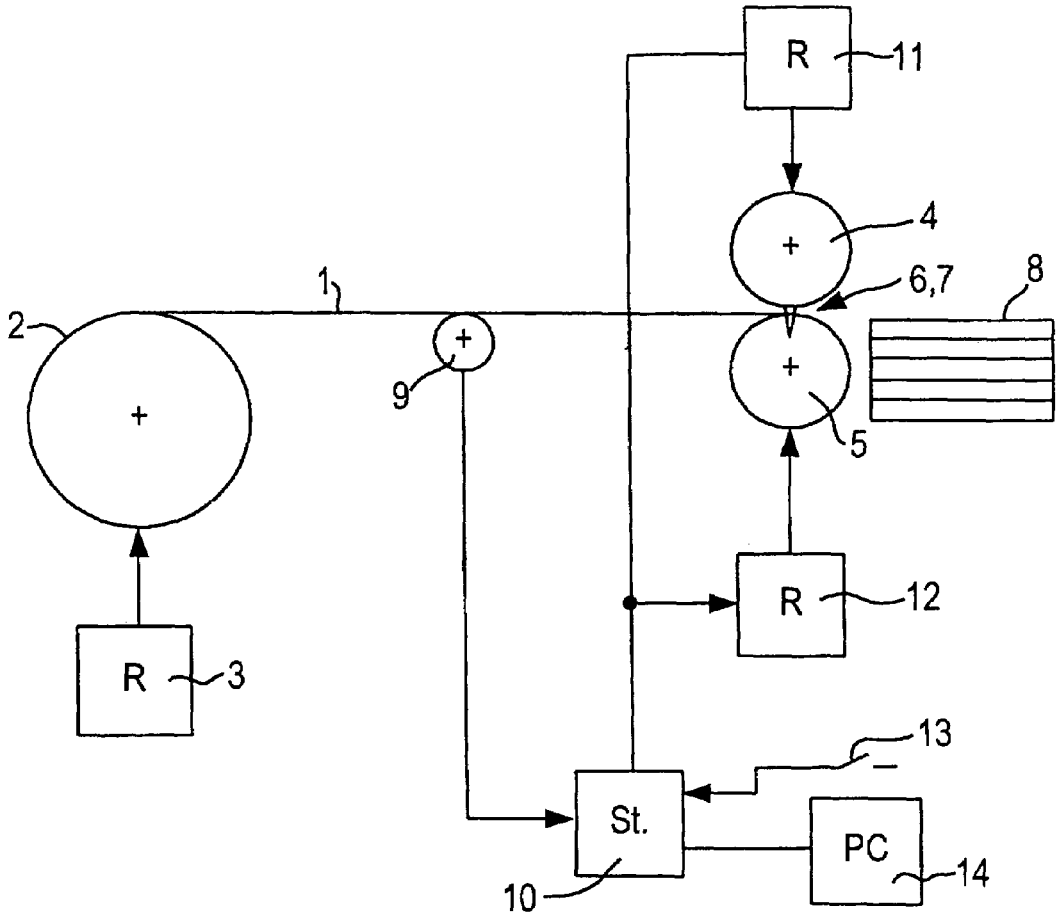
FIG. 1 gives a depiction, similar to a block circuit diagram, of a device according to the invention that is embodied in the form of a paper cross cutter.

According to FIG. 1, the material web 1 comprised of paper is unwound at a constant web speed starting at an unwinding device 2. A drive regulating unit 3 is used to achieve the constant speed of the material web 1 derived from a virtual guide axle. After being unwound, the material web 1 travels into the region of two rollers 4 and 5 disposed opposite each other. The two rollers 4 and 5 are each equipped with tools 6 and 7 that are disposed on the radial outside and are embodied in the form of knives for cutting the material web 1 into definite segments. The cut segments are then supplied to a collecting device 8, where they are temporarily stored. A sensor 9 disposed in the vicinity of the material web 1 serves to measure the material web speed. The material web speed measured by the sensor 9 is supplied to the input side of a control unit 10. Based on this speed, the control unit 10 determines desired position values of a virtual guide axle and sends them to drive regulating units 11 and 12 that are connected to its output side and are associated with each of the rollers 4 and 5. In accordance with the principle of a disk-cam table, a computing unit 14 likewise connected to the control unit 10 generates the data that the control unit 10 supplies, together with the data of the associated guide axle transmission, to the drive regulating units 11 and 12 of the two rollers 4 and 5.

By means of a changeover switch 13 associated with the input side of the control unit 10, the control unit 10 executes a change from the current engagement spacing of the two tools 6 and 7 to another engagement spacing as soon as the tool 6, 7 engages.

Figure 2:
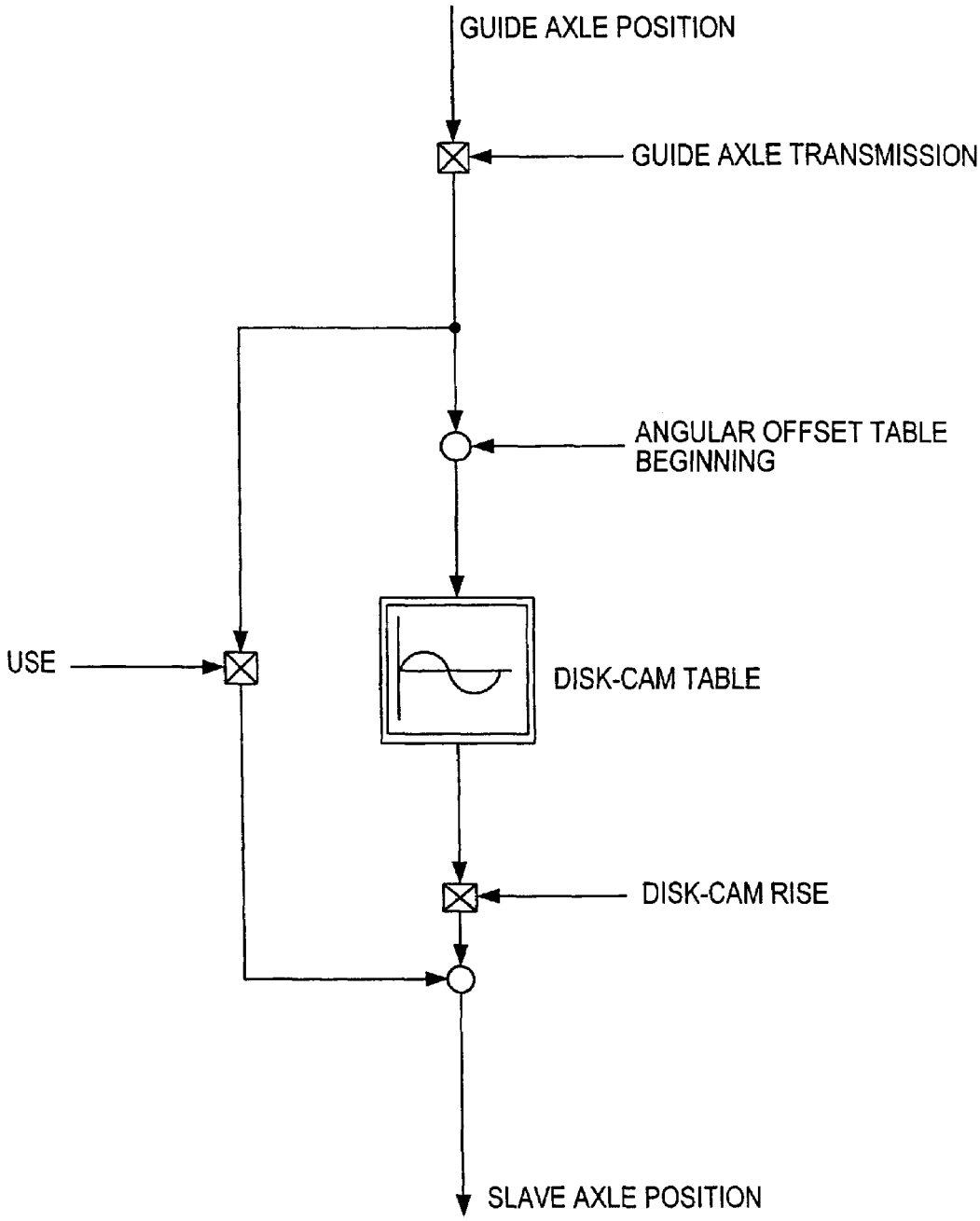
FIG. 2 shows a signal flow chart of the control of the rotating rollers.

According to FIG. 2, a signal processing of the preset guide axle position on the input side as well as of the guide axle transmission is carried out in order to execute the control. The guide axle position corresponds to the current position of the rollers, which are detected, for example, by an incremental transducer and can be supplied to the control. The data of the guide axle transmission are used to preset the desired engagement spacing in the form of a constant rotation speed for the rollers. In addition, due to the inclined position of the knives, an angular offset at the beginning must be taken into account in order to establish the desired cutting region. Then a disk-cam table determines the required differential curve for the acceleration or braking of the rollers, thus permitting a compensating motion to be produced between the circumferential speed of the tool during engagement, which corresponds to the material web speed, and the circumferential speed outside the tool engagement, which determines the engagement spacing. A change in the amplitude of the differential curve—comparable to the disk-cam rise—can be used to produce the synchronism in relation to the material web speed. An additional multiplier 1/use can be used to execute a control engineering-based adaptation to the number of tools per roller.

The invention is not limited to the exemplary embodiment disclosed above. Modifications of it are conceivable, which nonetheless fall within the scope of the invention defined by the claims. It is also conceivable for the invention to be used in a known paper cross cutting device that cuts a material web—which is divided into several longitudinal segments—with different engagement spacings, in such a way that different paper formats are produced simultaneously in each of the longitudinal webs, this embodiment permitting the engagement spacings to be changed independently of one another during operation.

| Reference Numeral List | |
|---|---|
| 1 | material web |
| 2 | unwinding device |
| 3 | drive regulating unit |
| 4 | roller |
| 5 | roller |
| 6 | tool |
| 7 | tool |

-continued

| Reference Numeral List | |
|---|---|
| 8 | collecting unit |
| 9 | sensor |
| 10 | control unit |
| 11 | drive regulating unit |
| 12 | drive regulating unit |
| 13 | changeover switch |
| 14 | computing unit |

The invention claimed is:

1. A method for changing the spacing at which a tool (6, 7)—which is disposed on a radial outside of at least one associated rotating roller (4, 5)—engages with a passing material web (1) moving in a straight line at a constant speed, where in a form of a disk-cam control for a duration of the engagement of the tool (6, 7) with the material web (1), a circumferential speed of the tool (6, 7) is synchronized with a speed of the material web (1) and for a time, a desired engagement spacing is determined by an increased or reduced circumferential speed of the roller (4, 5), characterized in that in order to execute a changeover of an engagement spacing of the tool (6, 7) with the material web (1), first a number of different engagement spacings are electronically predefined in a retrievable form in conjunction with different corresponding circumferential speeds of the tool (6, 7), wherein after an activation of a changeover switch (13), a change to another predefined engagement spacing during operation is executed precisely at a moment the tool (6, 7) engages so that a next time the tool (6, 7) engages with the material web (1), a new engagement spacing is executed wherein a disc cam table determines a differential curve used for the acceleration or braking of the roller (4, 5), thus permitting a compensation motion to be produced between the circumferential speed of the tool during engagement and the circumferential speed outside the tool engagement.

2. The method according to claim 1, characterized in that the engagement spacing of the tool (6, 7) with the material web (1) is determined by the circumferential speed of the tool (6, 7) in such a way that a uniform motion component is executed as a fundamental motion in order to determine the engagement spacing and is overlaid with a compensating motion component—which produces an acceleration or braking—in order to achieve an adaptation to the circumferential speed synchronous to the material web during the engagement of the tool (6, 7).

3. The method according to claim 2, characterized in that in order to produce a shorter engagement spacing of the tool (6, 7), a faster uniform motion component of the roller (4, 5) relative to the speed of the material web (1) is executed, whereas in order to produce a longer engagement spacing of the tool (6, 7), a relatively slower uniform motion component of the roller (4, 5) is executed.

4. The method according to claim 1, characterized in that a change in the amplitude of the differential curve is used to produce synchronism in relation to the material web speed.

5. A device for changing the spacing at which a tool (6, 7)—which is disposed on a radial outside of at least one associated rotating roller (4, 5)—engages with a passing material web (1) moving in a straight line at a constant speed, with an electronic control unit (10), which, in a form of a disk-cam control, synchronizes a circumferential speed of the tool (6, 7) with a speed of the material web (1) for a duration of the engagement of the tool (6, 7) with the material web (1), and for a time, determines the desired engagement spacing by setting an increased or reduced circumferential speed of the roller (4, 5), characterized in that the electronic control unit (10) provides, in a retrievable form, different circumferential speeds that represent desired engagement spacings, wherein according to the control unit (10), after an activation of a changeover switch (13), a change to another predefined engagement spacing is executed precisely at a moment the tool (6, 7) engages in order to execute a new engagement spacing a next time the tool (6, 7) engages whereby a computing unit (14), that is connected to the electronic unit (10), generates data in accordance with the principle of a disc-cam table, said disc cam table determines a differential curve used for the acceleration or braking of the roller (4, 5), the electronic control unit (10) supplies the data generated by the computing unit (14) to drive regulating units (11, 12).

6. The device according to claim 5, characterized in that a sensor (9) is provided to measure the speed of the material web (1) and is connected to an input side of the control unit (10), which, based on this speed, calculates desired values required for a control principle of a real guide axle.

7. The device according to claim 5, characterized in that electronically calculated speed data for the speed of the material web (1) are supplied to an input side of the control unit (10), which, based on these data, calculates required values desired for a control principle of a virtual guide axle.

8. The device according to claim 6, characterized in that the control unit (10) provides determined desired values for a guide axle of a drive regulating unit (11, 12) associated with each roller (4, 5), which allows the associated roller (4, 5) to be controlled in a position-controlled manner.

9. The device according to claim 5, characterized in that a computing unit (14) is provided that is connected to the control unit (10) and that electronically determines corresponding different disk-cam-like circumferential speeds of the tool (6, 7) based on different desired engagement distances of the tool (6, 7).

10. The device according to claim 5, characterized in that data determined by a computing unit (14), together with a virtual guide axle transmission data determined by the control unit (10), are stored directly in a drive regulating unit (11, 12) associated with each roller (4, 5).

11. The device according to claim 5, characterized in that the control unit (10) has a binary input as a changeover switch (13), which executes a change among a number of disk-cam-like sets of data stored in a drive regulating unit (11, 12) at a same time as associated guide axle data.

12. The device according to claim 5, characterized in that the tool (6, 7) is at least one knife, which is disposed on a radial outside of the rotating roller (4, 5) in order to cut a material web (1) into individual segments.

13. The device according to claims 5, characterized in that precisely two rollers (4, 5), which are disposed opposite each other and cooperate with each other to cut the material web (1), are provided with associated knife-like tools (6, 7).

14. The device according to claim 5, characterized in that the material web (1) is comprised of a paper material, a textile material, a plastic, or a metal.

* * * * *